United States Patent [19]

Doyel

[11] 4,365,714

[45] Dec. 28, 1982

[54] ONE-PIECE SHEETSTOCK BLANK AND A PACKAGE MADE THEREFROM

[76] Inventor: John S. Doyel, 404 W. 20th St., New York, N.Y. 10011

[21] Appl. No.: 283,336

[22] Filed: Jul. 14, 1981

[51] Int. Cl.[3] ..... B65D 73/00

[52] U.S. Cl. ..... 206/461; 206/491; 206/806; 229/38

[58] Field of Search ..... 206/491, 461, 467, 470, 206/806; 229/16 D, 27, 38

[56] References Cited

U.S. PATENT DOCUMENTS

| | | | |
|---|---|---|---|
| 3,148,770 | 9/1964 | Cosman | 206/806 |
| 3,214,075 | 10/1965 | Champlin et al. | 229/16 D |
| 4,291,807 | 9/1981 | Giordano et al. | 206/470 |
| 4,331,240 | 5/1982 | Vanasse | 206/491 |

*Primary Examiner*—Joseph Man-Fu Moy

*Assistant Examiner*—David T. Fidei

*Attorney, Agent, or Firm*—Cooper, Dunham, Clark, Griffin & Moran

[57] ABSTRACT

Disclosed is a one-piece sheetstock blank which is foldable along scorelines to form a package which has a flat rectangular base and a box-shaped hollow container for merchandise. The container extends forwardly from the base and has its backside at the base, its right, left, top and bottom sides extending forwardly from the base and its front side parallel to it spaced from the base. A peripheral portion of the flat base surrounding the container to the left, top, right and bottom thereof and provides a convenient and effective surface for advertising or explanatory written material. All visible surfaces of the package come from the same surface of the blank, which minimizes printing costs. The blank is formed into the package simply by folding along the scorelines, without the need for adhesives or stapling.

2 Claims, 4 Drawing Figures

ONE-PIECE SHEETSTOCK BLANK AND A PACKAGE MADE THEREFROM

BACKGROUND AND SUMMARY OF THE INVENTION

The invention is in the field of packages made from sheetstock blanks by folding the blanks along scorelines, and provides a particularly efficacious package which generally resembles a blister package but is made only from a one-piece sheetstock blank folded along scorelines.

DETAILED DESCRIPTION

Figure 1:
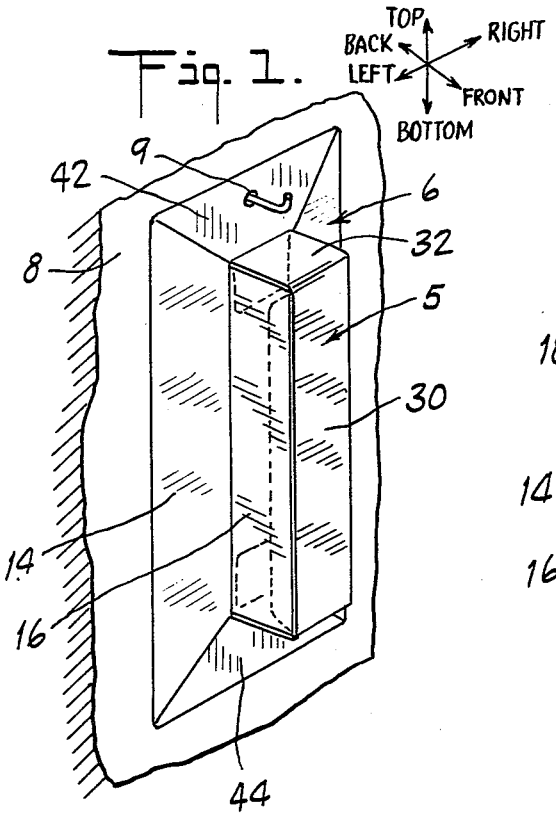
FIG. 1 is a perspective view of a package made in accordance with the invention, as it may be used in a store display.
Figure 2:
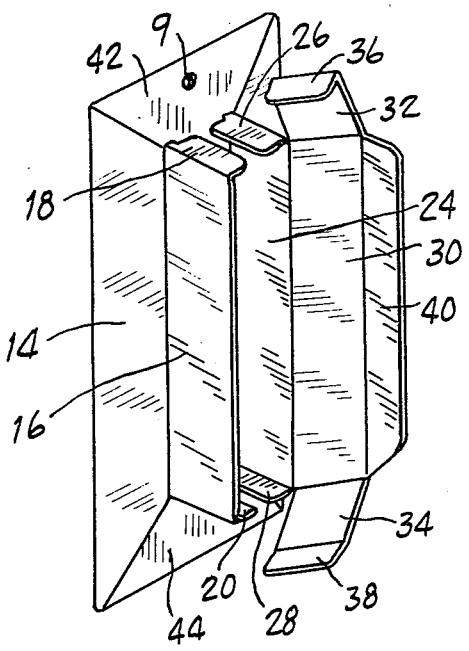
FIG. 2 is a perspective view of the package of FIG. 1 when partly unfolded.
Figure 3:
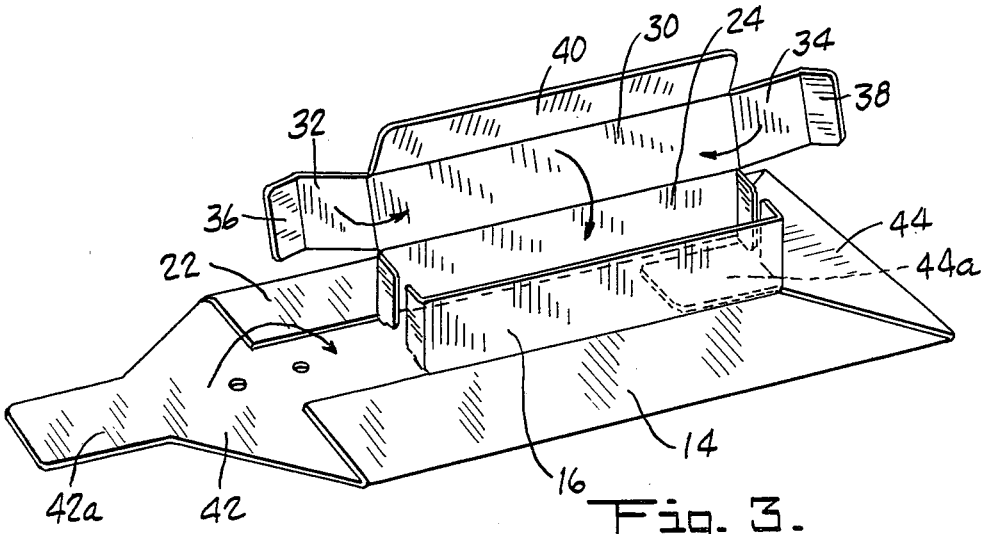
FIG. 3 is a perspective view of the package of FIGS. 1 and 2 when further unfolded.

Referring to FIG. 1, the package comprises a hollow box-shaped or parallelepiped-shaped container generally indicated at 5 which extends forwardly from a flat rectangular base generally indicated at 6 and may be displayed as by supporting it on a hook 7 which extends from a support 8 and passes through a suitable opening 9 at the top end of the package.

Figure 4:
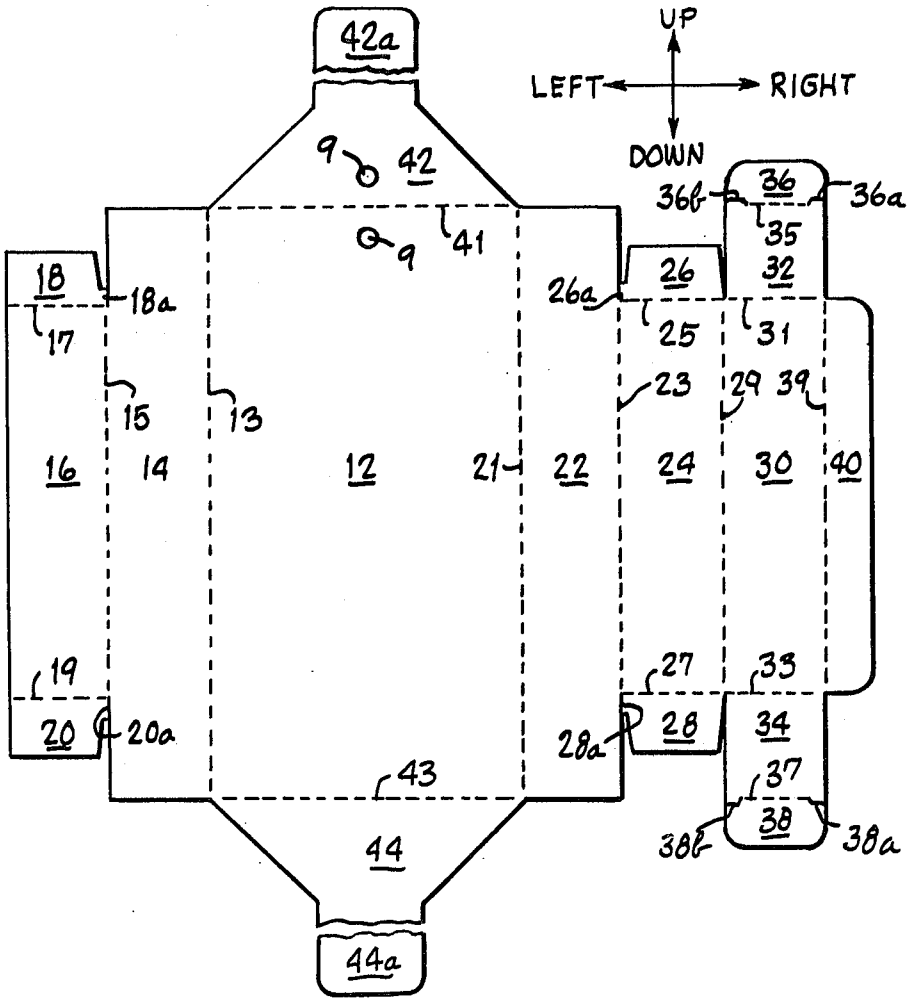
FIG. 4 is a plan view of a blank, with scorelines, which can be folded to form the package of FIGS. 1–3.

For convenience, the package is described with respect to the directions indicated at FIG. 1 and the blank is described with respect to the directions indicated at FIG. 4, it being understood that these directions apply only when the package is oriented as shown in FIG. 1 and the blank as shown in FIG. 4. The references below to "rectangular" include the special case of a square rectangle.

Referring to FIG. 4 and the directions indicated thereon, the blank for the package comprises a base panel 12 which is coextensive with the flat base 6 and forms the backside of the package. The base panel 12 has top, bottom, left and right sides and is bound at said sides by scorelines 41, 43, 13 and 21 respectively. The term scoreline is used herein to mean any weakening of the sheetstock along a given line which would facilitate folding it along such line. As a nonlimiting example, a scoreline may be formed by perforating, crimping or partly cutting the sheetstock along the indicated line.

A rectangular first left panel 14 extends to the left of the rectangular base panel 12 and is separated therefrom by scoreline 13. The vertical dimension of the panel 14 is the same as that of panel 12, and when the blank is folded to form the package the panel 14 is folded over panel 12 along scoreline 13 to form, together with panel 14, a double thickness portion of the flat base 6 which extends to the left (in FIG. 1) of container 5. A rectangular second left panel 16 extends to the left of the first left panel 14 and is separated therefrom by a scoreline 15, and a first flap 18 extends up from the topside of panel 16 and is separated therefrom by a scoreline 17 while a second flap 20 extends down from the bottom side of panel 16 and is separated therefrom by a scoreline 19. When the blank is folded to form the package, panel 16 is folded along scoreline 15 to be at a right angle with respect to panel 14 (which in the package is parallel to and overlays panel 12), and panel 16 becomes the left side of container 5, while flaps 18 and 20 are folded along scorelines 17 and 19 respectively to be at right angles to panel 16 and to extend into container 5 and to be concealed therein under the top and bottom sides thereof respectively. In addition, as described below flaps 18 and 20 hold down a top flap 42 and a bottom flap 44 when the package is in its completed form.

A rectangular first right panel 22 extends to the right of base panel 12 and is separated therefrom by scoreline 21. Panel 22 has the same vertical dimension as base panel 12 and in the package it is folded over panel 12 along scoreline 21 to form a double thickness portion of base 6 which is to the right of container 5. A rectangular second right panel 24 extends to the right of panel 22 and is separated therefrom by a scoreline 23. A third flap 26 extends up from the top end of panel 24 and is separated therefrom by a scoreline 25 and a fourth flap 28 extends down from the bottom end of panel 24 and is separated therefrom by a scoreline 27. When the package is formed, panel 24 is folded along scoreline 23 to be at a right angle to panel 22 (which in the package is parallel to and overlays panel 12) and becomes the right side of container 5, while flaps 26 and 28 are folded along scorelines 25 and 27 respectively to be at right angles to panel 24 and to extend into the container 5, to be concealed therein under the top and bottom sides thereof respectively. In addition, as explained below flaps 26 and 28 help flaps 18 and 20 hold down top flap 42 and bottom flap 44 when the package is in its completed form.

A rectangular third right panel 30 extends to the right of panel 24 and is separated therefrom by a scoreline 29. A fourth flap 32 extends up from the top end of panel 30 and is separated therefrom by a scoreline 31, and a fifth flap 34 extends down from the bottom end of panel 30 and is separated therefrom by a scoreline 33. A sixth flap 36 extends up from the top end of flap 32 and is separated therefrom by a scoreline 35, and a seventh flap 38 extends down from the bottom end of flap 34 and is separated therefrom by a scoreline 37. A fourth right panel 40 extends to the right of panel 30 and is separated therefrom by a scoreline 39. In the package, panel 30 is folded along scoreline 29 to be at a right angle to panel 24 and forms the front side of the container, panel 40 is folded along scoreline 39 to be at a right angle to panel 30 and to extend into the container 5, along the inside of the left side thereof, and to be concealed therein, flap 32 forms the topside of the container, flap 34 forms the bottom side of the container and flaps 36 and 38 are tucked in to extend into the container 5 and overlay a portion of the base panel 12 which is at the backside of container 5.

A top flap 42 extends up from the base panel 12 and is separated therefrom by scoreline 41, and a bottom flap 44 extends down from the panel 12 and is separated therefrom by scoreline 43. In the package of FIG. 1, flaps 42 and 44 are folded over the base panel 12 and over the panels 14 and 22, and the tapered top end part **42*a* of flap 42 and the tapered bottom end part 44*a* of flap 44 extend into the container 5, toward each other and along the base 6, and are concealed within container 5. Flaps 42 and 44 are held down, flat against the base panel 12, by the respective edges of flaps 18, 20, 26 and 28 which face flaps 42 and 44, as well as by flaps 36 and 38 which are tucked in between flaps 42 and 44 and the last recited edges of flaps 18, 20, 26 and 22 respectively and, in addition, by merchandise packed in container 5. A pair of apertures 9 are formed in the flap 42 and the panel 12 such that they register with each other when flap 42 is folded over panel 12, to allow for hanging the package on hook 7 as shown in FIG. 1**.

In a preferred sequence of steps, the blank is folded to form the package as follows: panels 14 and 22 are folded over base panel 12; panels 16 and 24 are folded to extend away from each other; flaps 18, 20, 26 and 28 are folded to extend, relative to the panels to which they are attached, in directions opposite the relative directions which they have in the completed package; flaps 42 and 44 are folded toward each other and over panels 14 and 22; panel 16 and its flaps 18 and 20 and panel 24 and its flaps 26 and 28 are moved to or close to the relative positions which they have in the completed package (and at this time merchandise may be placed in the partly formed container 5); panel 30 and its flap 40 are closed over the merchandise, with flap 40 tucked in inside container 5, behind panel 16; then flaps 32 and 34 are brought down and flaps 36 and 38 tucked into container 5.

Note that the cuts separating flaps 18 and 20 from panel 14 and flaps 26 and 28 from panel 22 are shaped as shown in FIG. 4 to have edge portions 18*a*, 20*a*, 26*a* and 28*a* which engage tightly flaps 42 and 44 in the completed package and hold them down against base panel 12, and that flaps 36 and 38 have partial cuts at 36*a*, 36*b*, 38*a* and 38*b* to serve as locking cuts which lock flaps 36 and 38 once they are tucked into container 5. In addition, note that all visible surfaces of the package come from the same side of the blank—which, of course, means that only one side of the blank need be printed with advertising or other material to have all (or any desired) visible surface of the package carry such materials.

While only a specific example is described above of the invented blank and package, it should be understood that the invention is limited only by the appended claims, which cover other examples as well.

What I claim is:

1. A one-piece sheetstock blank foldable along scorelines to form a package comprising a flat rectangular base and a parrelepiped-shaped hollow container which extends forwardly from the base and has its backside at the base, has its left, right, top and bottom sides extending forwardly from the base and has its front side parallel to and spaced from the base, said base having a peripheral portion which is made up of at least two thicknesses of the sheetstock and surrounds the container to the left, top, right and bottom thereof, said one-piece blank comprising:

a rectangular base panel coextensive with said flat base and having top, bottom, left and right sides;

a rectangular first left panel extending to the left of the base panel and separated therefrom by a scoreline, wherein when the blank is folded to form said package said first left panel is folded over the base panel at said scoreline to form together with the base panel a double thickness portion of the flat base which is to the left of the container;

a rectangular second left panel extending to the left of the first left panel and separated therefrom by a scoreline, a first flap and a second flap which extend up and down, respectively, from the top and bottom ends, respectively, of the second left panel and are separated therefrom by respective scorelines, wherein when said blank is folded to form said package, said second left panel forms the left side of the container and said first and second flaps are concealed behind and extend along the top and bottom sides of the container, respectively;

a rectangular first right panel extending to the right of the base panel and separated therefrom by a scoreline, wherein when the blank is folded to form said package the first right panel is folded over the base panel at the last recited scoreline to form, together with the base panel, a double thickness portion of the flat base which is to the right of the container;

a rectangular second right panel extending to the right of the first right panel and separated therefrom by a scoreline, and a third flap and a fourth flap which extend up and down, respectively, from the top and bottom ends, respectively, of said second right panel and are separated therefrom by respective scorelines, wherein when the blank is folded to form said package said second right panel forms the right side of the container and said third and fourth flaps are concealed behind and extend along the top and bottom sides of the container, respectively;

a rectangular third right panel extending to the right of the second right panel and separated therefrom by a scoreline, a fourth flap and a fifth flap extending up and down, respectively, from the top and bottom ends of the third right panel and separated therefrom by the respective scorelines, a sixth flap extending up from the top end of the fourth flap and separated therefrom by a scoreline and a seventh flap extending down from the bottom end of the fifth flap and separated therefrom by a scoreline, wherein when the blank is folded to form said package the third right panel forms the front side of the container, the fourth and fifth flaps from the top and bottom sides of the container, respectively, and the sixth and seventh flaps are concealed into the container and extend over and along the flat base toward each other;

a fourth right panel which extends to the right of the third right panel and is separated therefrom by a scoreline, wherein when the blank is folded to form said package, the fourth right panel is concealed into the container and extends behind and along the inside of the left side thereof;

a top flap extending up from the base panel and separated therefrom by a top scoreline, and a bottom flap extending down from the base panel and separated therefrom by a bottom scoreline, wherein in the folding of the blank to form said package and after the folding as recited of the first left and first right panels, the top and bottom flaps are folded along the top and bottom scorelines respectively over respective parts of the first left panel and first right panel and over the base panel to form respective portions of the flat base which are at least two thicknesses of the sheetstock and extend above and below the container, respectively, wherein the top extremity of the top flap and the bottom extremity of the bottom flap are concealed within said container, extending toward each other along the base panel.

2. A blank as in claim 1 including means defining apertures in the base panel and in the top flap which register with each other when the top flap is folded over the base panel in forming the package to allow for hanging the package on a hook.

* * * * *